US005966574A

United States Patent [19]

Ui et al.

[11] Patent Number: 5,966,574

[45] Date of Patent: Oct. 12, 1999

[54] DEVELOPER REPLENISHING APPARATUS

[75] Inventors: Makoto Ui; Shigeru Okazaki; Masahiro Yoshino; Eiji Anzai, all of Hachioji, Japan

[73] Assignee: Konica Corporation, Japan

[21] Appl. No.: 09/217,705

[22] Filed: Dec. 21, 1998

[30] Foreign Application Priority Data

| | | | |
|---|---|---|---|
| Dec. 24, 1997 | [JP] | Japan | 9-366075 |
| Dec. 24, 1997 | [JP] | Japan | 9-366076 |
| Dec. 24, 1997 | [JP] | Japan | 9-366328 |
| Dec. 24, 1997 | [JP] | Japan | 9-366329 |

[51] Int. Cl.[6] ..... G03G 15/08

[52] U.S. Cl. ..... 399/258; 399/260; 399/262; 222/DIG. 1

[58] Field of Search ..... 399/258, 252, 399/260, 262, 263, 119, 120; 222/DIG. 1, 167, 325; 141/256, 363; 347/86

[56] References Cited

U.S. PATENT DOCUMENTS

| | | | |
|---|---|---|---|
| 5,296,900 | 3/1994 | Saijo et al. | 399/260 |
| 5,722,020 | 2/1998 | Matsuoka et al. | 399/262 |
| 5,774,773 | 6/1998 | Otsuka et al. | 399/262 |

*Primary Examiner*—William Royer
*Assistant Examiner*—Hoan Tran
*Attorney, Agent, or Firm*—Jordan B. Bierman; Bierman, Muserlian and Lucas

[57] ABSTRACT

A developer replenishing apparatus includes: a developer storing container for storing a developer therein; a first driving source for rotating the developer storing container to supply the developer; a developer reservoir section for receiving the developer supplied from the developer storing container; a conveying screw for replenishing the developer in the developer reservoir section onto a developing device; a second driving source for driving the conveying screw; and a stirring member for stirring the developer in the developer reservoir section, the stirring member having a first and second one-way clutches provided on a driving shaft thereof. The stirring member is driven by the first driving source through the first one-way clutch, and driven by the second driving source through the second one-way clutch.

14 Claims, 13 Drawing Sheets

DEVELOPER REPLENISHING APPARATUS

BACKGROUND OF THE INVENTION

The present invention relates to a developer replenishing apparatus used for a developing unit provided in an electrophotographic type image forming apparatus or the similar apparatus.

Conventionally, when developer (toner) is replenished to a developer reservoir section (a toner reservoir section), a delivery port of a developer storing container (a toner bottle or toner storing container) in which developer is stored, is mated with a replenishing port of the reservoir section, and the developer (toner) is replenished into the container at a stroke. However, phenomenon in which the developer scatters like as smoke, (emitting smoke phenomenon) occurs, and therefore, there is a possibility that the developer stains the periphery of the developer reservoir section.

Accordingly, recently, the following developer replenishing apparatus is used: a toner bottle is provided above the developer reservoir section so that the bottle can be rotated in the peripheral direction; by rotating the toner bottle in the peripheral direction, the developer is moved to one side by a rib of the inner peripheral surface corresponding to a spiral groove provided on the outer peripheral surface; and the developer can be gradually replenished from a delivery port provided on one side to the developer replenishing port.

In the developer reservoir section, a conveying screw to convey the replenished developer to the developing unit is provided, and further, a stirring member is also provided so as to level a hill of the developer replenished in the reservoir section and to make the replenished developer to be well mixed with the existing developer.

However, in the conventional apparatus, an operation to rotate the toner bottle in the peripheral direction and replenish the toner, is conducted singly, and the stirring member in the reservoir section is operated at a timing to operate a conveying screw to convey the replenished developer to the developing unit. Therefore, there is a problem in which the toner replenished from the toner bottle forms a hill in the reservoir section, thereby, an amount of toner is unstable.

Further, in the case where the stirring member is simultaneously operated when the toner bottle is rotated in the peripheral direction and the toner is replenished to the reservoir section, and in the case where the stirring member is not operated but only the conveying screw is singly operated when the developer in the reservoir section is conveyed to the developing unit, only toner around the conveying screw is moved, and toner still remains around that, which is disadvantageous.

Still further, when the operation in which the toner bottle is rotated in the peripheral direction and the toner is replenished to the reservoir, the operation of the stirring member, and the operation of the conveying screw in the reservoir section, are conducted simultaneously, the following problem occurs: when an amount of toner replenishment from the toner bottle to the reservoir section is not the same as an amount of toner conveyance to the developing unit by the conveying screw, the amount of toner in the reservoir section is gradually decreased, or overflows, and is unstable.

Yet further, it is considered that a driving source to rotate the toner bottle in the peripheral direction, a driving source of the stirring member, and a driving source of the conveying screw, are separately provided respectively, and the operation timing of them is controlled so that above problems do not occur even when these are independently operated. However, there is a problem that the production cost is increased when these driving sources are individually provided.

FIG. 8 is a sectional view showing a structure of the inside of the developer replenishing apparatus. In FIG. 8, the bottle-like toner storing container 5, which is extending vertically to the drawing, is supported by a container supporting section 21 of the developer replenishing apparatus 100 having a corresponding concave portion. A toner reservoir section 1 whose sectional view is approximately U-shaped, is formed below the container supporting section 21. Toner T replenished from the toner storing container 5 is piled in the toner reservoir section 1.

A sensor 124 to detect a remaining amount of toner T in the toner reservoir section 1 is located on the side surface of the toner reservoir section 1. The sensor 124 has a detecting surface 124*a* facing the inside of the toner reservoir section 1. Further, a plate-like stirring member 28 for stirring the toner T in the toner reservoir section 1, attached to a driving shaft 29 is located so as to be rotatable by the external driving power, at the center of the toner reservoir section 1. The stirring member 28 has also a function to clean the detecting surface 124*a*.

The sensor 124 is composed of a piezoelectric element, and can detect toner T contacting with its detecting surface. Accordingly, even when a piling level of the toner T is lower than the sensor 124, when only a small amount of toner T adheres to the detecting surface, the sensor 124 erroneously detects that an amount of toner T, which exceeds the level of the detecting surface, remains.

Therefore, the stirring member 28 to clean the detecting surface 124*a* of the sensor 124 is provided. That is, by rotating the driving shaft 29, the stirring member 28 is slidingly moved on the detecting surface. By such the sliding movement, the toner T adhered to the detecting surface 124*a* is removed, thereby, the detecting accuracy of the sensor 124 is increased.

However, by such the movement of the stirring member 28, a new problem occurs. The stirring member 28 is rotated in the direction of an arrow (clockwise) in FIG. 8 such that the stirring member 28 cleans the detecting surface 124*a* from below. Accordingly, the toner T adhered to the detecting surface 124 is cleaned by cleaning of stirring member 28, however, when toner T is removed by the rotating stirring member 28, there is a possibility that a cavity S of toner T is formed below the stirring member 28.

When such the cavity is formed, even if the remaining amount of toner T is enough, there is a possibility that the sensor 124 erroneously detects the toner T as if its remaining amount is lower than a predetermined level.

As a method to solve this problem, it is considered that a plurality of optical sensors are provided in the toner reservoir section, and the remaining amount of toner is collectively judged from the detected results. However, when a plurality of sensors are provided, cost of the toner replenishing apparatus, and further, the cost of an image forming apparatus is increased.

Furthermore, in the case of the toner bottle installation type developer replenishing apparatus, a member which is rotated together with the toner bottle is necessary, and only on a portion engaging with developer delivery port of the toner bottle of the rotating member, a seal member is provided.

Accordingly, it is necessary to make the member rotated with the toner bottle coincide with the surface on which the developer delivery port of the toner bottle is provided, therefore, there is a problem in which not only the adjustment is troublesome, but the member rotated with the toner bottle also exists, resulting in an increase of production cost.

Still further, because the delivery port of the toner storing container by the conventional technology is formed on a cylindrical surface, and the delivery port is sealed by a thin seal, generally it is difficult to peel the seal by a simple mechanism. Therefore, the operator is required to manually peel the seal directly before the toner storing container is set to the toner replenishing device. Accordingly, even when such the toner replenishing device is used, a possibility that hands are still stained, is not solved. In addition to that, there also be a request to use again the seal which has been peeled once, so as to seal the delivery port.

SUMMARY OF THE INVENTION

In order to solve the above many problems, an object of the present invention is to provide a developer replenishing apparatus by which an amount of developer stored in the developer reservoir section is stabilized, the developer does not form a cavity in the reservoir section, and reduction of production cost can be expected.

Further, another object of the present invention is to provide a control method of a powder replenishing apparatus by which the cost is not greatly increased, and the accuracy of a toner detection sensor is more increased.

Still another object of the present invention is to provide a developer replenishing apparatus in which the developer delivered from the delivery port of the toner bottle does not leak along the slide-contact surface formed between a bottle and a seal member. Further object of the present invention is to prove a developer replenishing apparatus in which replacement of a deteriorated seal member is easy.

In view of the foregoing problem of the conventional technology, yet further object of the present invention is to provide a toner storing container which has almost no possibility to stain hands of the operator or the circumference.

The above objects are attained by a developer replenishing apparatus having the following structure: a first driving source to rotate a developer storing container to replenish the developer; a developer reservoir section to which the developer is replenished from the developer storing container by the drive of the first driving source; a conveying screw to replenish the developer in the developer reservoir section to a developing unit; a second driving source to drive the conveying screw; a stirring member to stir the developer in the developer reservoir section; and a first and a second one-way clutches provided on a driving shaft of the stirring member, wherein the stirring member is driven by the first driving source through the first one-way clutch, and driven by the second driving source through the second one-way clutch.

DETAILED DESCRIPTION OF THE PREFERRED EMBODIMENT

Figure 1:
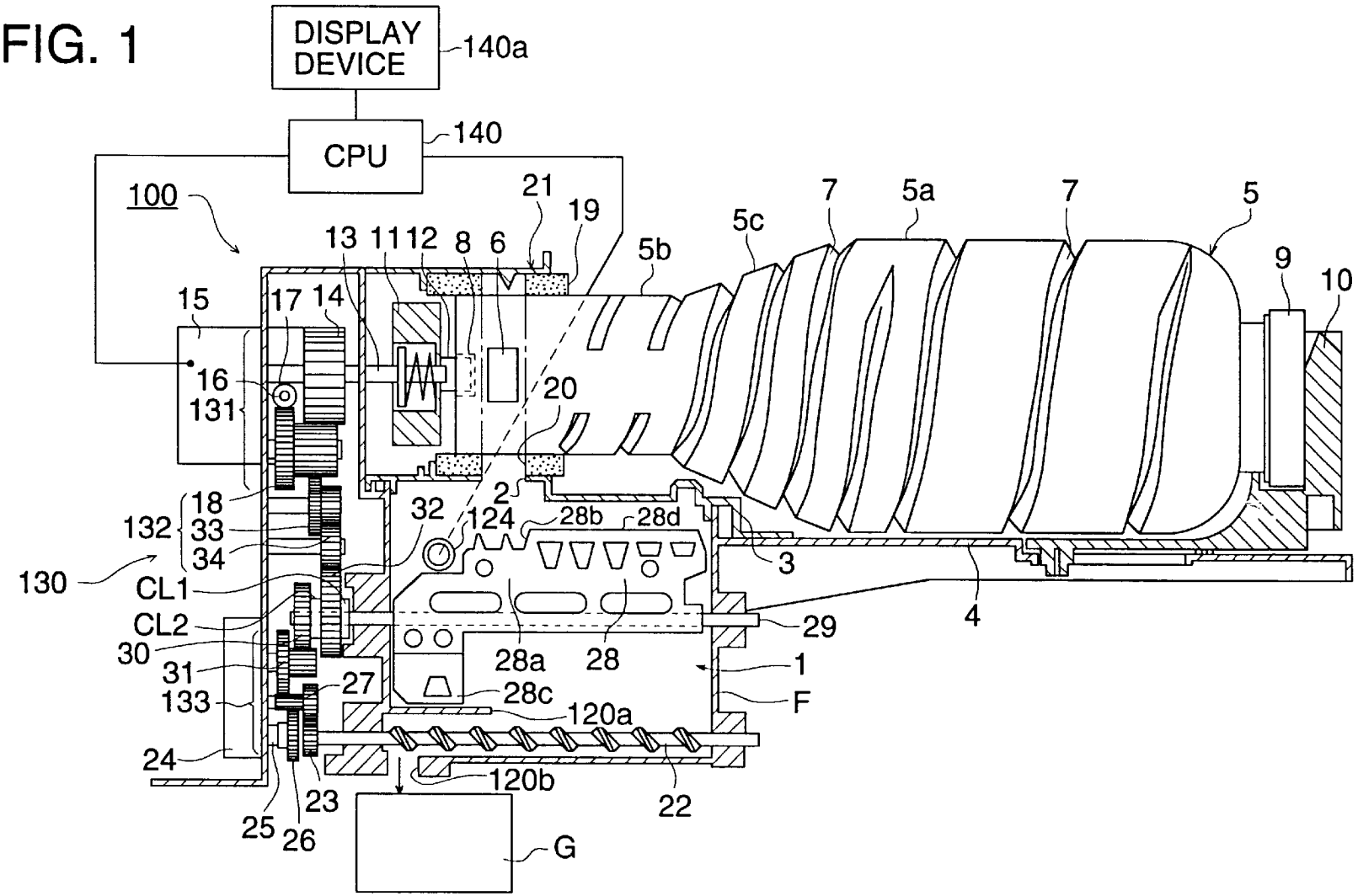
FIG. 1 is a sectional view of a developer(toner) replenishing apparatus of the present invention.

Next, referring to the drawings, an example of the present invention will be described. In this connection, in the following description, sometimes developer is referred to as toner.

In FIG. 1, numeral 1 is a developer reservoir section (toner reservoir section) to store the developer (toner) which is supplied to a developing unit G, and a toner replenishing port 2 is provided on the upper surface of the toner reservoir section 1. A rack 4 which is continuous through a step portion 3 is horizontally provided on the upper surface of the toner reservoir section 1 provided with the toner replenishing port 2, and a developer storing container (a toner bottle or toner storing container) 5 can be horizontally held.

The toner bottle 5 is structured by a large cylindrical portion 5*a* to store the toner, a small cylindrical portion 5*b* having a toner delivery port 6 on one side, and a shoulder portion 5*c* which is narrowed from the large cylindrical portion 5*a* toward the small cylindrical portion 5*b*.

A rib 7 is provided on the inner peripheral surface corresponding to a spiral groove which is provided on the outer peripheral surface of the toner bottle 5. When the toner bottle is rotated in the peripheral direction, the groove 7 can move the toner stored inside the bottle from the large cylindrical portion 5*a* to the small cylindrical portion 5*b*. Two concave grooves 8 in which 2 claw pieces 12 of a rotor 11, which will be described later, can be engaged, are provided on a top surface of the small cylindrical portion 5*b*. Further, a cap 9 which can be opened when toner is stored, is inserted with pressure in the center of the bottom surface of the large cylindrical portion 5*a*.

A pressure plate 10 to press the bottom surface of the large cylindrical portion 5*a* of the toner bottle 5 toward the small cylindrical portion 5*b* side, is provided on an end portion of the rack 4. The pressure plate 10 is moved forward by an operation of a handle (not shown). That is, the toner bottle 5 is placed on the rack 4 under the condition that the pressure plate 10 is moved backward by the handle operation, and when the pressure plate 10 is moved forward, the small cylindrical portion 5*b* is engaged into an inner hole of the seal member 19, and toner bottle 5 is set at a regular position and its position is held.

The above-described regular position of the toner bottle 5 implies the position in the state in which the two concave grooves 8 provided on the top surface of the small cylindrical portion 5*b* of the toner bottle 5 are engaged with the two claw pieces 12 provided on the rotor 11 facing to the grooves 8, and the toner delivery port 6 provided on one side surface of the small cylindrical portion 5*b* can coincide with the toner replenishing port 2 at the time of rotation in the peripheral direction.

A gear 14 fixed on the end portion of the shaft 13 of the rotor 11 is interlocked with the driving source 15 (the first driving source) through an intermediate gear 18 engaged with a gear 17 fixed on the output shaft 16 of the driving source 15, and the rotor 11 can be rotated in a predetermined direction by the rotation of the driving source 15. Accordingly, the toner bottle 5 having the concave grooves 6 engaged with the claw pieces 12 of the rotor 11 on its top surface, can be singly rotated in the peripheral direction by the driving source 15.

The toner stored in the bottle is moved from the large cylindrical portion 5*a* toward the small cylindrical portion 5*b* by the action of spiral rib 7 provided on the inner peripheral surface by the rotation of the toner bottle 5 in its peripheral direction, at last, delivered from the delivery port 6 provided on one side of the small cylindrical portion 5*b*, and is gradually replenished from the toner replenishing port 2 into the toner reservoir section 1.

A seal member 19 can be slidingly engaged with the small cylindrical portion 5*b* of the toner bottle 5 so that the toner delivered from the toner delivery port 6 provided on its one side is securely guided to the toner replenishing port 2 of the toner reservoir section 1.

Figure 2:
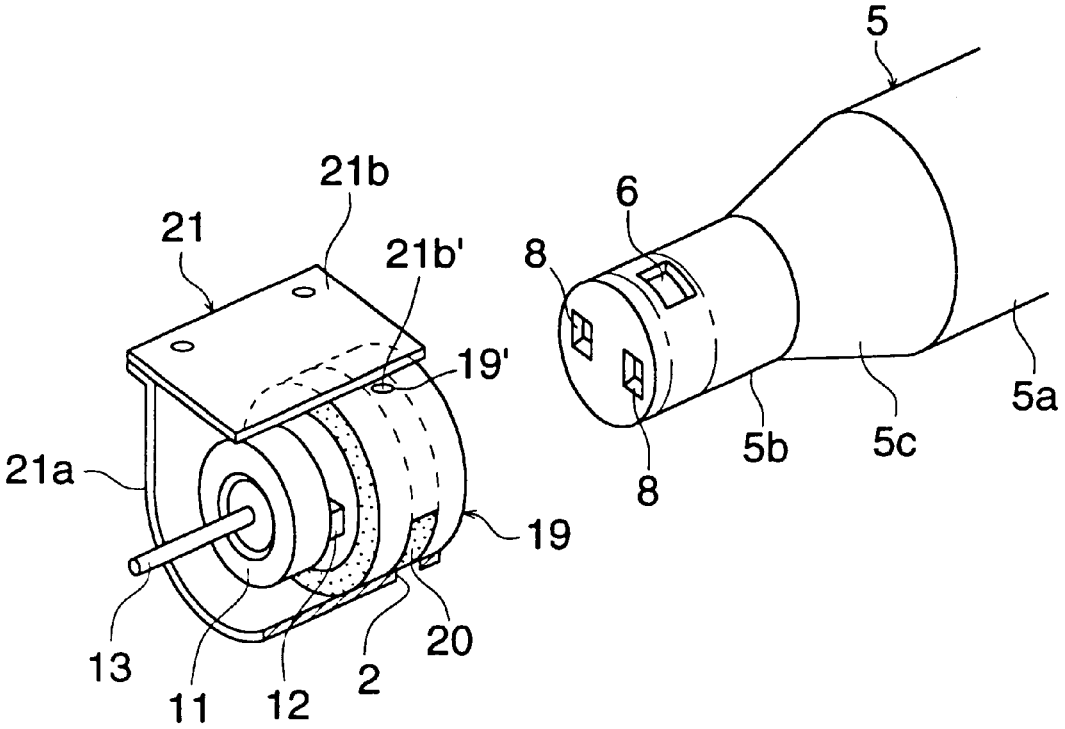
FIG. 2 is an abbreviated perspective view showing the relationship between a seal member and a toner bottle, which are used in the apparatus of the present invention.
Figure 3:
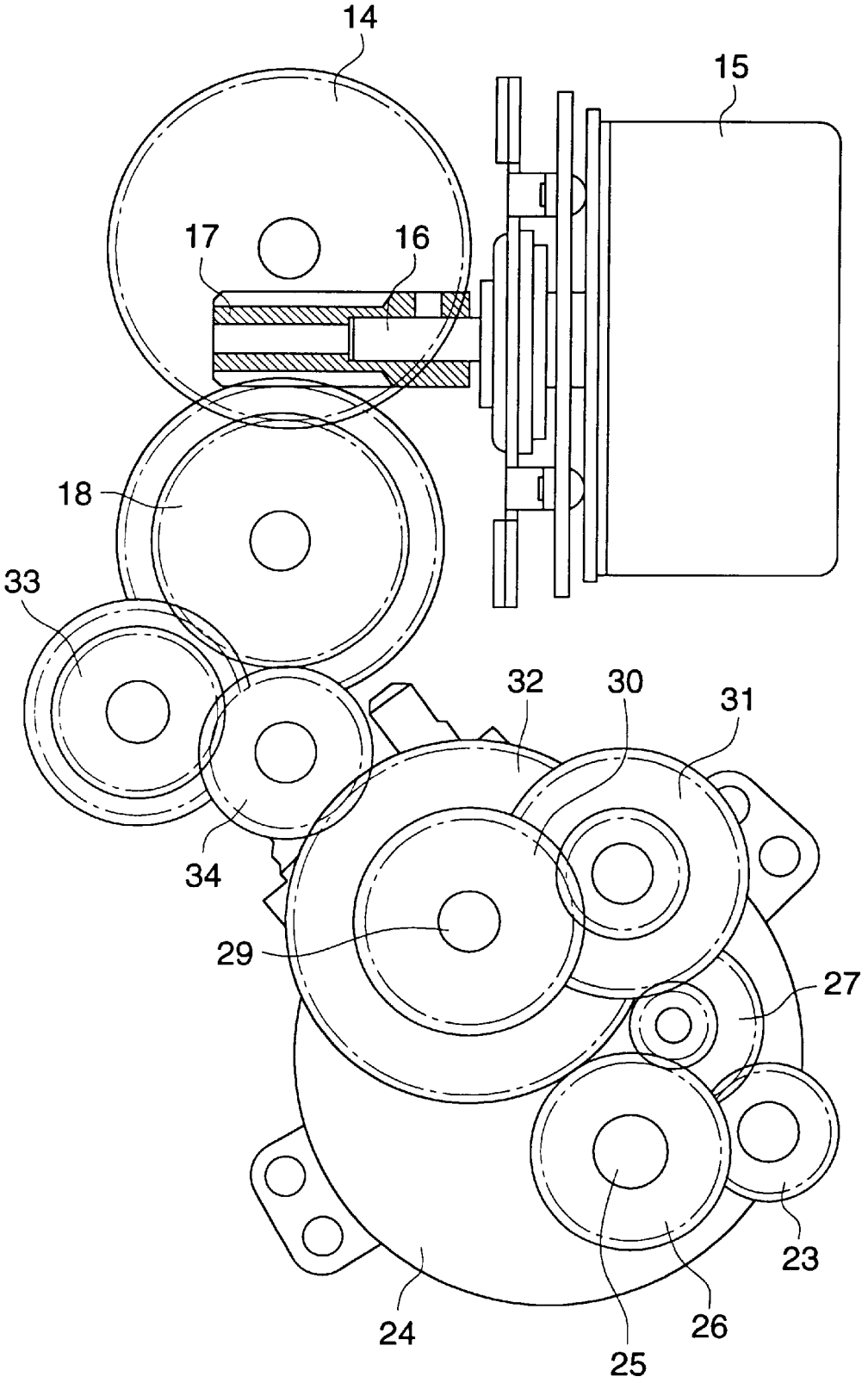
FIG. 3 is a view showing a driving system of a developer storing container and a driving system of a conveying screw.

The seal member 19 can be mounted on the toner reservoir section 1 by a supporting frame 21 so that a toner through-hole 20 provided on one side of the seal member 19 coincides with the toner replenishing port 2 (refer to FIG. 2). The supporting frame 21 can vertically hold and fix the seal member 19 by a U-shaped lower frame 21a and a flat upper frame 21*b*, and stably holds the seal member 19 so that it is not rotated by following the rotation of the toner bottle 5.

In FIG. 2, a protruded member 21*b*' is provided on the inner surface of the upper frame 21*b* of the supporting frame 21 as an auxiliary means so that the seal member 19 can be stably held by the supporting frame 21, and the protruded member 21*b*' is engaged in a receiving hole 19' provided on the upper surface of the seal member 19.

Incidentally, in order to stably hold the seal member 19 by the supporting frame 21, it is of course that a double sided adhesive tape (not shown) may be provided between the U-shaped lower frame 21*a* and the seal member 19, or a telescopic protrusion and a concave portion (not shown) may be provided between the U-shaped lower frame 21*a* and the seal member 19, if necessary.

A conveying screw 22 to convey the developer from the reservoir section 1 to the developing unit G is provided in the developer reservoir section 1. A gear 23 is fixed on the end portion of the conveying screw 22, and the gear 23 can be singly rotated through an intermediate gear 27 engaged with a gear 26 fixed on an output shaft 25 of a driving source 24 (the second driving source).

The stirring member 28 to stir the toner is provided in the reservoir section 1, and a gear 30 housing therein a one-way clutch CL2 (the second one-way clutch)is fixed on the shaft end of a driving shaft 29 of the stirring member 28. The gear 30 housing therein the one-way clutch CL2 is interlocked with the driving source 24 for the conveying screw through the second intermediate gear 31 engaged with the intermediate gear 27 which is engaged with the gear 26 fixed on the output shaft 25 of the driving source 24.

Accordingly, when the conveying screw 22 is operated by the drive of the driving source 24 for the conveying screw, the conveying screw 22 is integrated with a driving shaft 29 of the stirring member 28 by the action of the one-way clutch CL2 housed in the gear 30, and thereby, the stirring member 28 is connected to the driving system of the conveying screw 22.

A gear 32 housing therein a one-way clutch CL1 (the first one-way clutch), in the same manner, is fixed on the driving shaft 29 of the stirring member 28 together with the gear 30. The gear 32 housing therein the one-way clutch CL1 is interlocked with the driving source 15 for the toner bottle through the second intermediate gear 33, engaged with the intermediate gear 18 which is engaged with the gear 17 fixed on the output shaft 16 of the driving source 15 for the toner bottle, and the third intermediate gear 34.

Accordingly, when the toner bottle 5 is rotated by the drive of the driving source 15, the driving shaft 29 of the stirring member 28 is integrated with the driving system of the toner bottle 5 by the action of the one-way clutch CL1 housed in the gear 32 and connected to the driving system.

In the apparatus of the present invention described above, when the image forming apparatus is started, and the rotor 11 is rotated by the gears interlocked with the driving source 15, the toner bottle 5 is rotated in its peripheral direction by the driving power of the rotor 11, moves the toner stored in its barrel from the barrel portion 5*a* toward the neck portion 5*b* by the action of the spiral grooves 7, delivers the toner from the toner delivery port 6 provided in the neck portion 5*b*, and gradually replenishes it to the replenishing port 2 of the developer reservoir section 1.

When the toner bottle 5 is rotated by the action of the driving source 15 for the toner bottle through the rotor 11, the one-way clutch CL1 housed in the gear 32 is operated, and the gear 32 is integrated with the driving shaft 29 of the stirring member 28 and connected to the driving source 15. On the other hand, the gear 30 is disengaged from the driving shaft 29 of the stirring member 28 by the action of the one-way clutch CL2 housed in the gear 30.

Reversely, when the conveying screw 22 is rotated by the action of the driving source 24 for the conveying screw, the one-way clutch CL2 housed in the gear 30 is operated, and the gear 30 is integrated with the driving shaft 29 of the stirring member 28 and connected to the driving source 24. On the other hand, the gear 32 is disengaged from the driving shaft 29 of the stirring member 28 by the action of the one-way clutch CL1 housed in the gear 32.

In other words, when the toner bottle 5 is rotated and the toner is replenished into the reservoir section 1, the stirring member 28 is also operated simultaneously with the operation of the toner bottle, and on the other hand, when the toner is conveyed from the reservoir section 1 to the developing unit G, the stirring member 28 can be operated simultaneously with the operation of the conveying screw 22.

As described above, in the present invention, the driving shaft of the stirring member is interlocked with the driving source of the toner bottle and the driving source of the conveying screw through respective one-way clutches, thereby, when the toner is replenished from the toner bottle into the reservoir section, the stirring member 28 is also operated simultaneously with the operation of the toner bottle, and when the toner is conveyed from the reservoir section to the developing unit, the stirring member is also operated simultaneously with the operation of the conveying screw. Accordingly, the present invention can attain the following excellent effects: an amount of toner stored in the toner reservoir section is stabilized; the toner forms no cavity in the reservoir section; and the driving source is not necessary for the stirring member, thereby, reduction of the production cost can be expected for it.

Further, as shown in FIG. 1, the driving shaft 29 provided so as to cross the toner reservoir section 1 formed below the container supporting section 21, is rotatably supported by the frame F. The stirring member (a removing means having also a cleaning function) 28 formed of overlapped 2 plates is screwed on the driving shaft 29. The stirring member 28 is composed of a central plate 28*a* having relatively high rigidity, formed of, for example, metal or the like, and a cleaning stirring plate 28*b* formed of PET or the like, to be overlapped on the central plate 28*a*.

The almost L-shaped cleaning stirring plate 28*b* having flexibility, has a cleaning portion 28*c* which is largely protruded in the direction of radius of the driving shaft 29 more than the central plate 28*a*, and a stirring portion 28*d* which is less protruded than the cleaning portion 28*c*. On the cleaning stirring plate 28*b*, many openings are provided so that the stirring easiness for toner is increased.

A long and narrow opening 120*a* is formed below the toner reservoir section 1, and the conveying screw 22 is rotatably positioned below the opening 120*a*. A supply port 120*b* to supply the toner to the developing unit G is formed below the conveying screw 22. Further, in the middle of the toner reservoir section 1, a sensor 124 to detect the remaining amount of toner is located. Such the position of the sensor 124 is determined corresponding to the capacity of the toner reservoir section 1 such that, even if the toner storing container 5 becomes empty, a predetermined amount of image formation can be carried out by the toner accumulated to the position of the sensor 124. The sensor 124 is connected to the CPU 140 and detection signal is transmitted to the CPU. The CPU 140 can drive a display device 140*a* formed of, for example, a liquid crystal panel.

The driving source 15 is located above the driving section 130, and the driving source 15 and the driving shaft 13 of the container supporting section 21, which are a replenishing means, are connected to each other through a gear train 131 so that the driving power can be transmitted. The driving source 15 is connected to the driving shaft 29 of the stirring member 28 in the toner reservoir section 1 through a gear train 132 so that the driving power can be transmitted. Further, the driving source 15 is connected to the CPU and receives a driving signal therefrom. One-way clutches CL1 and CL2 are respectively provided in the gear trains 132 and 133, and when the driving source 15 is regularly rotated, only the toner storing container 5 is rotated, and when the driving source 15 is reversely rotated, only the stirring member 28 is rotated. However, the toner storing container 5 and the stirring member 28 may be independently rotated by using separated motors.

Figure 4:
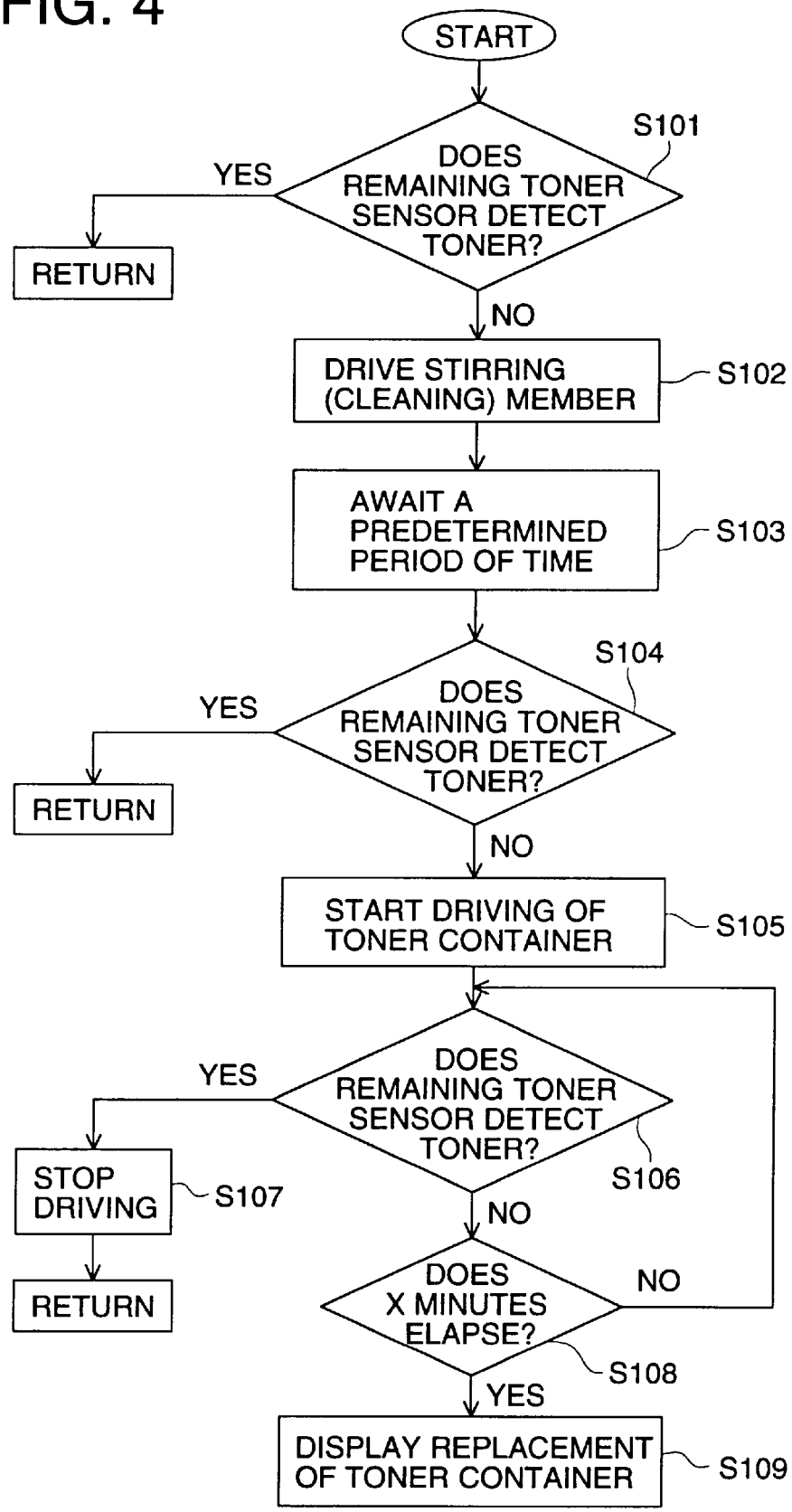
FIG. 4 is a flow chart showing operations of a present example.

Next, referring to flow charts, operations of the present example will be described. FIG. 4 is a flow chart showing operations of the present example. In step S101 in FIG. 4, initially, when the CPU 140 judges that toner exists, according to a signal from the sensor 124, the sequence flow returns. On the other hand, when the CPU 140 judges that no toner exists, according to a signal from the sensor 124, in the following step S102, the CPU drives the driving source 15, and the stirring member 28 is rotated by a predetermined angle. Depending on the rotated angle of the stirring member 28, an amount of toner stabilized in the toner reservoir section 1 can be changed. For example, when the rotation angle is changed within the range of 70° to 110°, the amount of toner is changed within the range of 180 g to 150 g. In this connection, in the present example, the rotation angle is set to 90° (the amount of toner is 160 g). Further, in the following step S103, the sequence awaits a predetermined period of time.

Herein, a reason for rotating the stirring member 28 and a reason for awaiting for a predetermined period of time, will be described below. As described in relation to FIG. 8, the case where the sensor 124 sends the signal meaning that no toner exists, includes the following: the case in which the remaining amount of toner in the toner reservoir section 1 is small; and the case in which a sufficient amount of toner remains, however, after the cleaning portion 28C cleans the detection surface, the sensor 124 detects a cavity (refer to FIG. 8) formed below the cleaning portion 28C. Accordingly, it is necessary to judge that to either case the signal meaning that no toner exists, detected in step S101, belongs.

Figure 8:
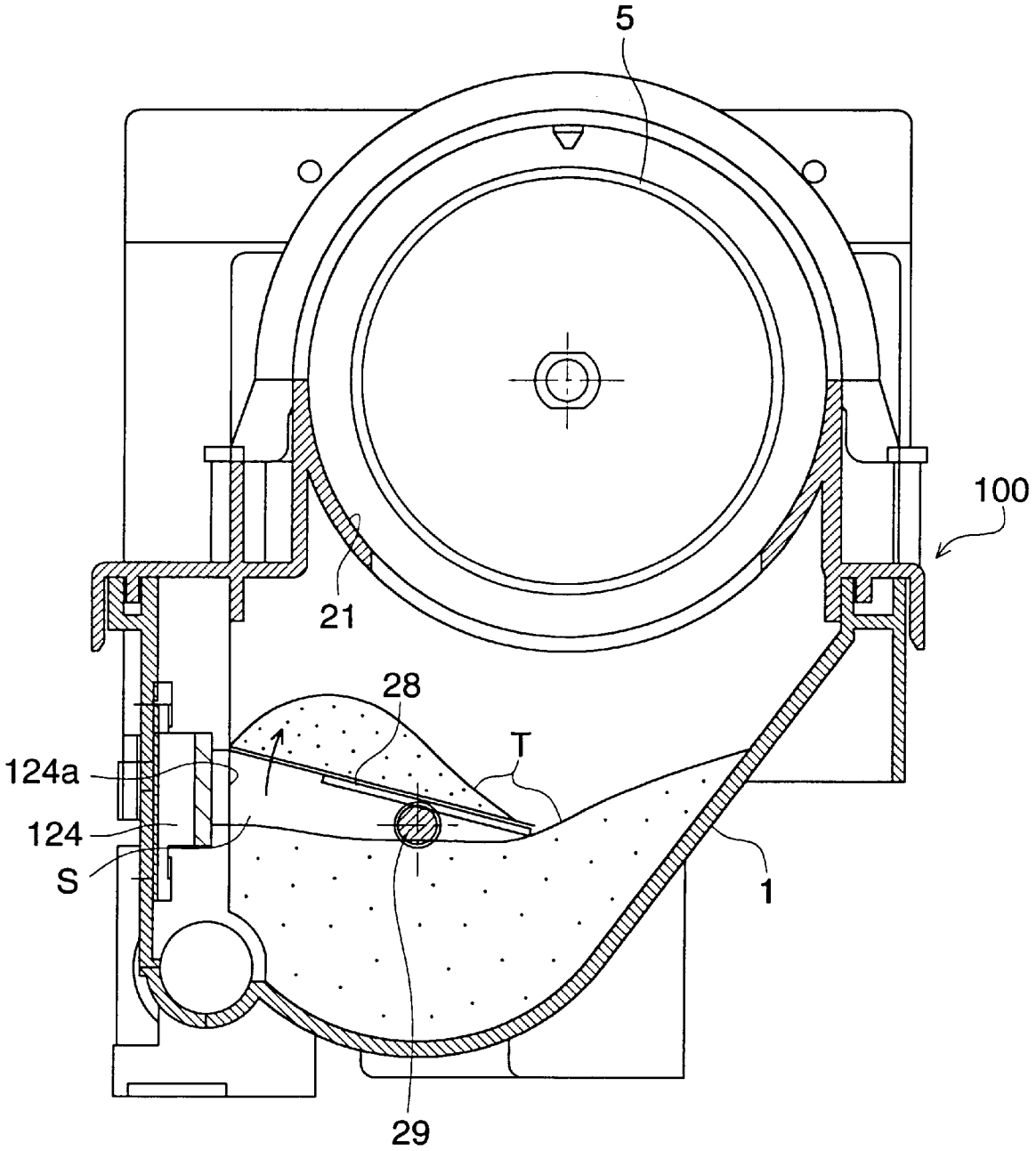
FIG. 8 is a sectional view showing an internal structure of the toner replenishing apparatus.

However, when the stirring member 28 is rotated, for example, by 90° from the position shown in FIG. 8, the toner located on the upper surface of the stirring member 28 falls in the toner reservoir section 1, and the stirring portion 28*d* stirs the right side (FIG. 1) in the toner reservoir section 1, thereby, the toner is leveled uniformly, and the cavity formed in front of the sensor 124 is eliminated. Accordingly, the predetermined period of time for awaiting, is equal to a period of time during which the toner is leveled and the cavity is eliminated.

Further, in step S104, when the CPU 140 judges that toner exists, according to the signal from the sensor 124, because the sufficient amount of toner exists, the sequence flow returns. On the other hand, when the CPU 140 judges that no toner exists, according to the signal from the sensor 124, because it means that insufficient toner exists, the CPU 140 drives the driving section 15 in the following step S105, and rotates the toner storing container 5.

When the toner storing container 5 is rotated, the toner is successively pushed toward the delivery port 6 side by the rib formed on the inner periphery corresponding to the spiral grooves on the outer periphery, and the toner falls in the toner reservoir section 1 every time when the delivery port 6 faces downward.

Further, in step S106, when the CPU 140 judges that toner exists, according to the signal from the sensor 124, it means that the remaining amount of toner reaches a predetermined level by the replenishment of toner, therefore, the CPU 140 stops the rotation of the toner storing container 5 in step 107, and the sequence flow returns. On the other hand, when the CPU 140 judges that no toner exists, according to the signal from the sensor 124, there is a possibility that the toner storing container 5 is empty. Accordingly, in the following step S108, while the toner storing container 5 is maintained in operation, the CPU 140 waits for X minutes, during which it is considered that all the toner in the container is delivered. After waiting for X minutes, when the CPU 140 judges that no toner exists, according to the signal from the sensor 124, the CPU 140 judges that the toner storing container 5 is empty, stops the drive of the toner storing container 5 in step S109, and makes the display device 140*a* display that the replacement of the toner storing container is necessary.

Figure 5:
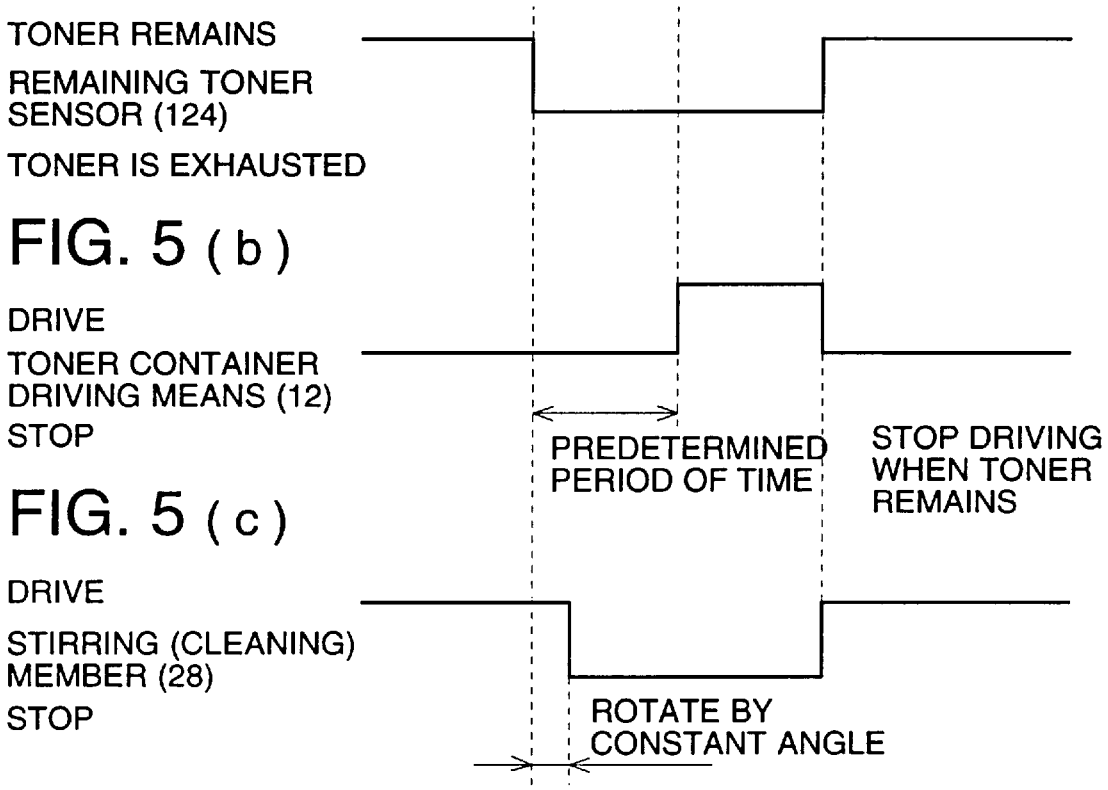
FIGS. 5(*a*), 5(*b*), and 5(*c*) are sequence diagrams respectively showing operations of a sensor 124, a protruded portion 12 which is a container driving means, and a stirring member 28.

FIGS. 5(*a*), 5(*b*) and 5(*c*) are sequence diagrams showing operations of the sensor 124, the protruded portion 12, which is a container driving means, and the stirring member 28. The sensor 124 detects that no toner exists (FIG. 5(*a*)), and the stirring member 28 is rotated after that (FIG. 5(*c*)), however, when the sensor 124 still detects that no toner exists, the toner storing container 5 is rotated by rotating the protruded portion 12 (FIG. 5(*b*)). After that, when the sensor 124 detects that the toner exists, the rotation of the protruded portion 12 is stopped. As described above, according to the present example, only by changing the control of the CPU 140, existence or no-existence of the toner remaining amount can be detected with high accuracy.

Figure 6:
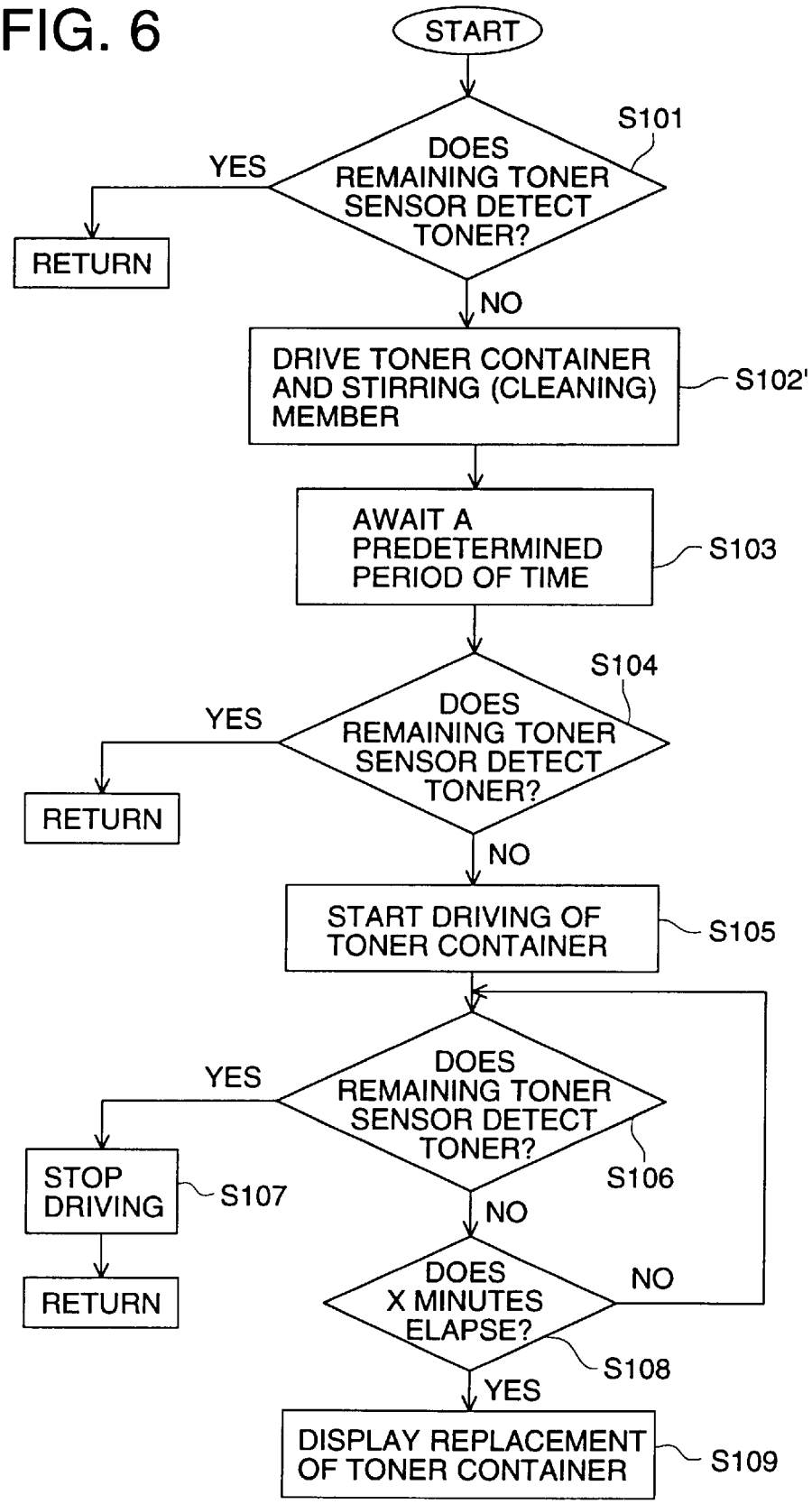
FIG. 6 is a modified view of FIG. 4.
Figure 7:
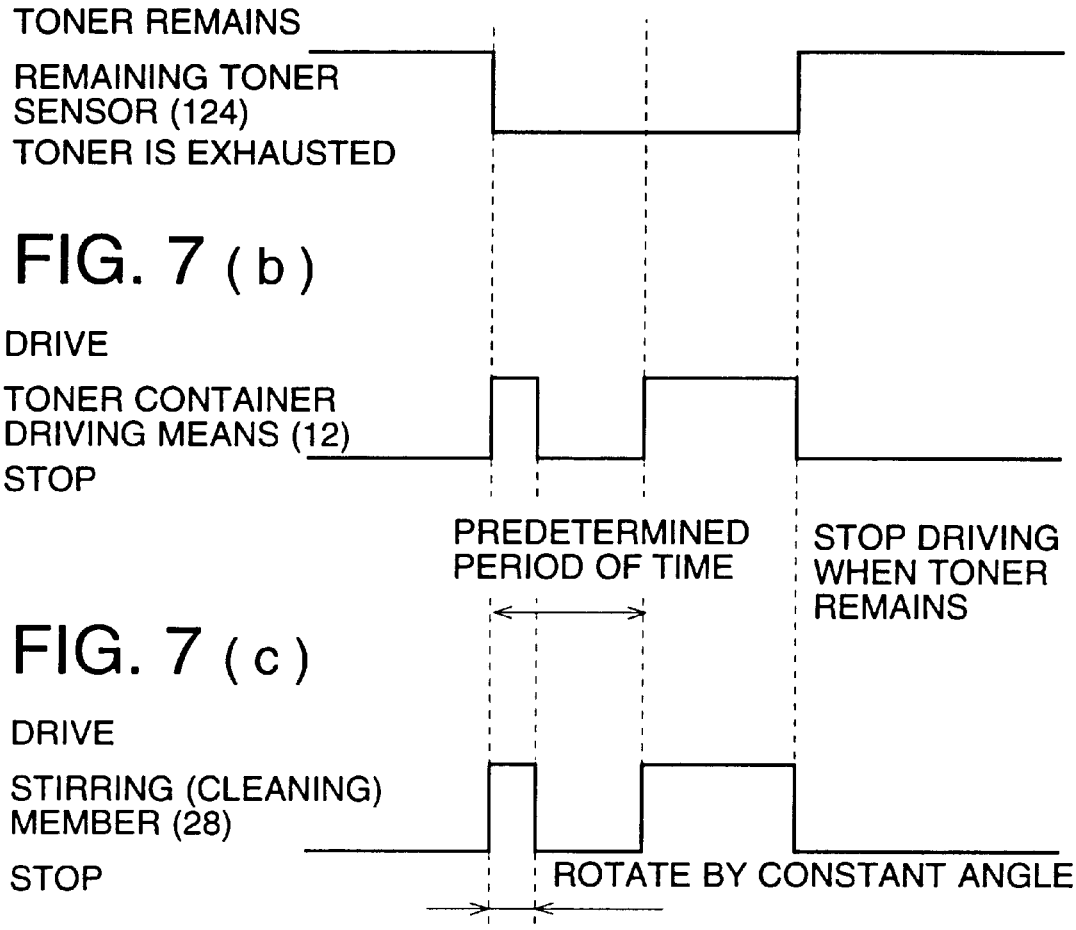
FIGS. 7(*a*), 7(*b*), and 7(*c*) are modified views of FIGS. 5(*a*), 5(*b*), and 5(*c*).

Next, modification of the present example will be described. FIGS. 6, 7(*a*), 7(*b*), and 7(*c*) are similar drawings to FIGS. 4, 5(*a*), 5(*b*), and 5(*c*) which show the modification. In the above example, the stirring member 28 has the structure in which the stirring member 28 can be driven separately from the toner storing container 5 or the conveying screw 22, however, in the present modification, the stirring member 28 has the driving mode in which the stirring member 28 is rotated together with either of the toner storing container 5 or the conveying screw 22.

More concretely, in the present modification, the toner storing container 5 and the stirring member 28 are driven by the driving source 15 in FIG. 1. Herein, the toner storing container 5 and the stirring member 28 are respectively driven by the driving source 15 through gear trains 131 and 132. On the other hand, the conveying screw 22 and the stirring member 28 are driven by the driving source 24. Herein, the conveying screw 22 and the stirring member 28 are driven by the driving source 15 through the gear train 133. The one-way clutch CL2 is provided between the stirring member 28 and each gear trains, so that the driving force from the gear train 132 and the driving force from the gear train 133 do not compete with each other. That is, the stirring member 28 is, rotated being interlocked with the rotation of both of the conveying screw 22 and the toner storing container 5. When toner is supplied to the developing unit G, the stirring member 28 is also driven to prevent a cavity which is generated in the toner in the toner reservoir section 1 by the rotation of the conveying screw 22.

Referring to FIG. 6, further description will be made below. When the CPU 140 judges that no toner exists, according to the signal from the sensor 124 (step S101), the CPU 140 rotates the toner storing container 5 and the stirring member 28 by a predetermined angle (FIGS. 7(*b*) and 7(*c*)), by rotating the driving source 15 in step S102'. In this connection, when a rotation ratio of the toner storing container 5 and the stirring member 28 when the driving source 15 is rotated is not set to a value approximately more than 0.5, balance between the amount of toner supplied from the toner storing container 5 and the stirring frequency is not well.

Accordingly, the gear ratio of the gear trains 131 and 132 are set such that, when the toner storing container 5 is rotated at 20 rpm, the stirring member 28 is rotated at 15 rpm. In this connection, the gear ratio of the gear trains 132 and 133 are set such that, when the conveying screw 22 is rotated at 30 rpm, the stirring member 28 is rotated at 4 rpm.

Steps subsequent to step S102' are the same as those in the above example, however, according to the above-described reason, the stirring member 28 is rotated together with the toner storing container 5 in step S105 (FIGS. 7(*b*) and 7(*c*)). According to this modification, other than the same effects as in the above example, it is not necessary to drive the driving source 15 regularly and reversely, thereby, the driving system is simplified, resulting in a decrease of cost.

Referring to the example, the present invention is described above. However, for example, according to the present example, a cavity generated in the toner in the toner reservoir section is eliminated by rotating the stirring member, however, the cavity may also be eliminated by using another means for applying vibration onto the toner reservoir section.

According to the control method of the present invention, the control method consists of: a step to make the sensor detect the powder; a step to make the sensor detect the powder again after passage of a predetermined period of time when the sensor detects that the powder is not in contact with the detecting section; and a step to make the replenishing means supply the powder to the reservoir section when the sensor detects again that the powder is not in contact with the detecting section. Accordingly, even when, after the removing means removes the powder adhered to the detecting section, no power exists in the vicinity of the detecting section, for example, the control sequence awaits for a predetermined period of time until the powder is leveled uniformly, thereby, the sensor can detects more accurately the remaining amount of the powder, and according to the detected result, the control method can make the replenishing means supply the powder to the reservoir section.

Figure 9:
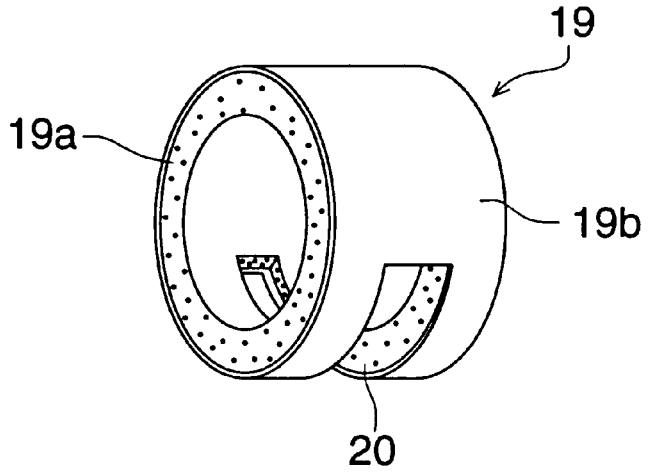
FIG. 9(*a*) is a perspective view of a seal member used in the apparatus of the present invention, and FIG. 9(*b*) is a sectional view of the seal member.
Figure 9:
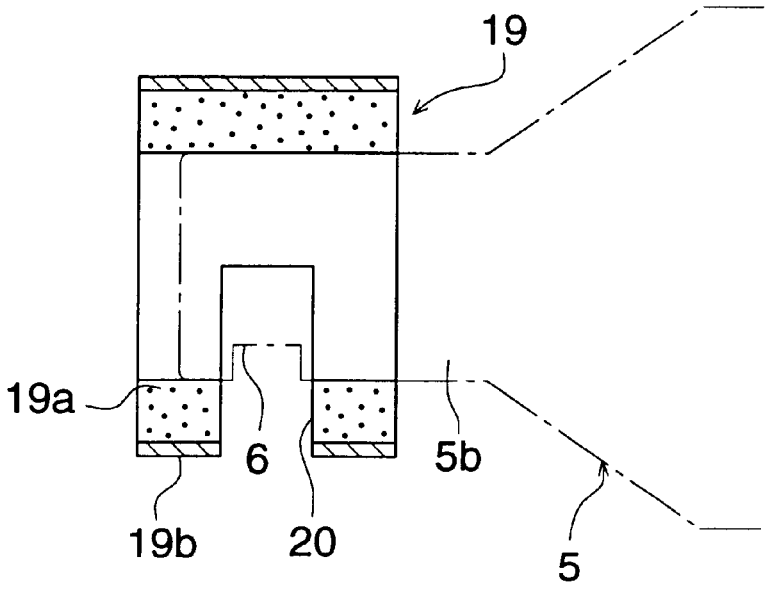

Although the shape of the seal member 19 shown in FIG. 1 is not specifically a subject matter, its representative shape will be shown in FIGS. 9(*a*), 9(*b*), 10(*a*), 10(*b*), 11(*a*), and 11(*b*). That is, when a seal member, in which a thin and rigid shell member 19*b* such as PET material is provided on the outer periphery of a ring member 19*a* formed of a material having a good elasticity and sliding property, such as foaming urethane, having the toner through-hole 20 on one side, is used, the member is excellent in the sealing performance and the stability of the shape.

Figure 10:
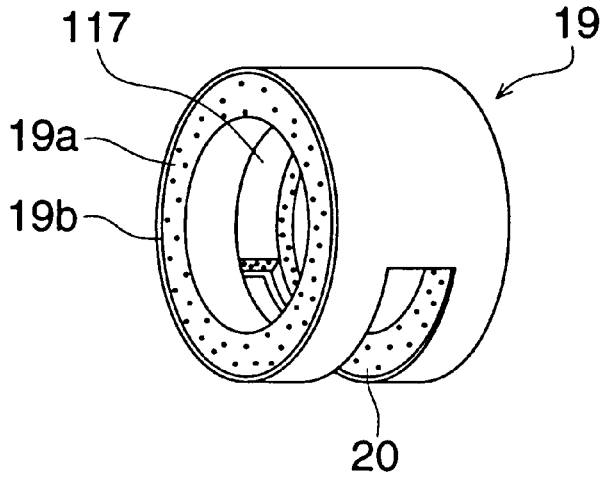
FIG. 10(*a*) is a perspective view of the second seal member used in the apparatus of the present invention, and FIG. 10(*b*) is a sectional view of the seal member.
Figure 10:
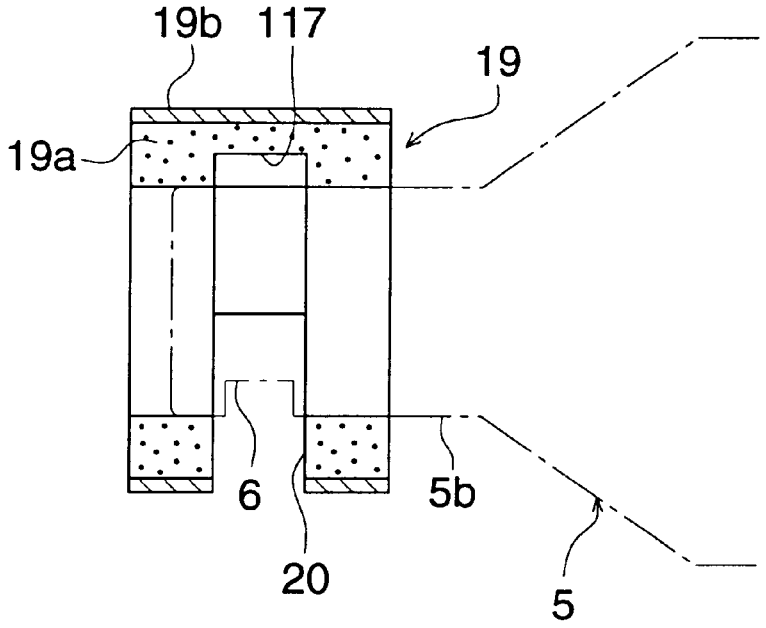

In the seal members 19, the member shown in FIGS. 9(*a*) and 9(*b*), has the shape in which its inner peripheral surface is entirely in close contact with the small cylindrical portion 5*b* of the toner bottle 5. Alternatively, the member shown in FIGS. 10(*a*) and 10(*b*) has the shape in which a ring-shaped groove 117 is provided on the inner peripheral surface passing through the toner through-hole 20, and is not in sliding-contact with the toner delivery port 6 when the toner delivery port 6, provided on one side of the small cylindrical portion 5*b* of the toner bottle 5, is rotated in the peripheral direction.

Figure 11:
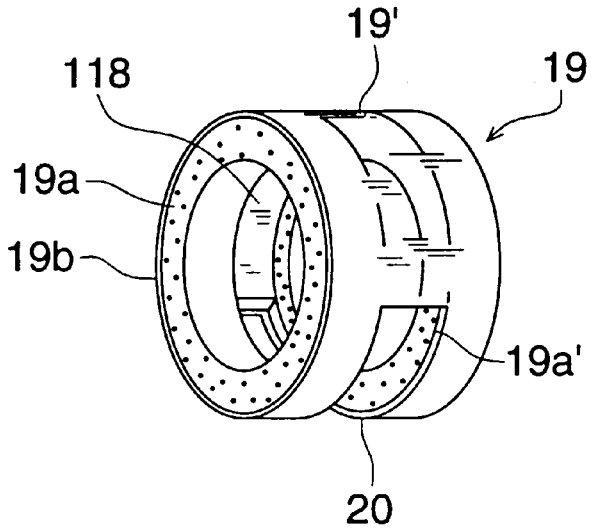
FIG. 11(*a*) is a perspective view of the third seal member used in the apparatus of the present invention, and FIG. 11(*b*) is a sectional view of the seal member.
Figure 11:
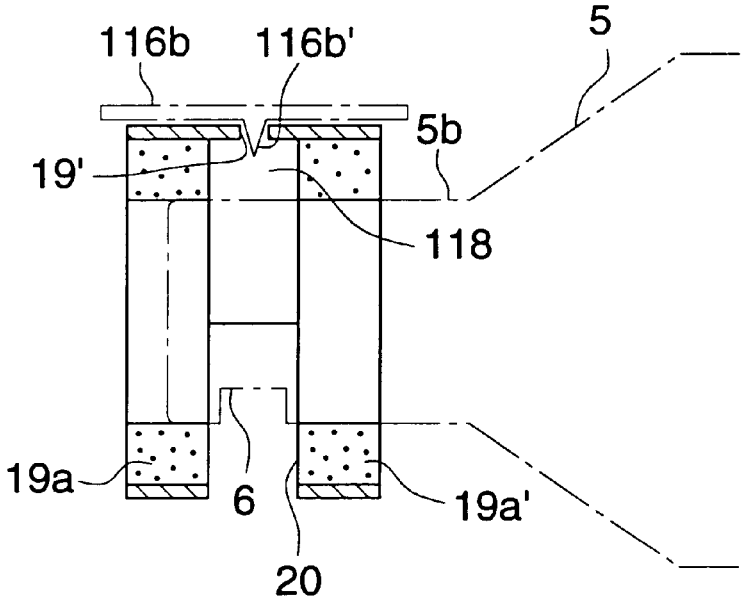

Further, the seal member 19 shown in FIGS. 11(*a*) and 11(*b*), has the shape in which the shell member 19*b* is fixed on the outer periphery of the 2 ring members 19*a* and 19*a*' so that the shell member 19*b* covers the outer periphery, wherein the delivery port 6, provided on one side of the small cylindrical portion of the toner bottle 5, is sandwiched between the 2 ring members 19*a* and 19*a*' which are facing to each other, and a ring-shaped space 118 is formed with which the toner delivery port 6, provided on one side of the small cylindrical portion 5*b* of the toner bottle 5, is not in sliding-contact.

Three shapes of the seal member 19 are shown here, and each of which has the satisfactory function in which, when the toner bottle 5 is rotated, and the delivery port 6 provided on the one side of the small cylindrical portion 5*b* of the bottle 5 coincides with the toner through-hole 20 of the seal member 19, the toner is replenished to the toner replenishing port 2 in the developer reservoir section 1. However, in the seal member 19 shown in FIGS. 9(*a*) and 9(*b*), there is a possibility that the developer adhered to edge portions of the toner delivery port 6 is carried to the inner surface of the seal member 19 by the rotation of the toner bottle 5, and a possibility that the conveyed developer is accumulated with the passage of time, and rarely causes developer leaking, can not be absolutely denied.

In contrast to this, in the seal members shown in 10(*a*), 10(*b*), and 11(*a*), 11(*b*), the ring-shaped groove 117 and the ring-shaped space 118 are provided on the inner periphery, thereby, there is no possibility that the toner adhered to edge portions of the toner delivery port 6 is carried to the inner surface of the seal member 19.

In the apparatus of the present invention described in the above example, initially, the seal member 19 is mounted such that the toner through-hole 20 coincides with the toner replenishing port 2 provided on the upper surface of the developer reservoir section 1, and the seal member 19 is stably fixed by the supporting frame 21.

The toner bottle 5 which is thus set in the seal member 19, is positioned such that the toner delivery port 6 provided on the one side of its small cylindrical portion 5*b* can coincide with the toner through-hole 20 of the seal member 19, and two concave grooves 8 on the top surface of the small cylindrical portion 5*b* are engaged with two claw pieces 12 of the rotor 11.

Then, the image forming apparatus is started, and the rotor 11 interlocked with the driving source 15 by gears is rotated, the toner bottle 5 is rotated in the peripheral direction by the driving power of the rotor 11, the toner stored in its barrel is moved from the large cylindrical portion 5*a* toward the small cylindrical portion 5*b* by the action of the spiral grooves 7, and delivered from the toner delivery port 6 provided in the small cylindrical portion 5*b*, and gradually replenished to the replenishing port 2 of the developer reservoir section 1.

In this case, the seal member 19 is not rotated together with the toner bottle 5, and when the toner bottle 5 is slidingly rotated in the peripheral direction and the toner delivery port 6 provided in the small cylindrical portion 5*b* coincides with the toner through-hole 20 provided on the lower surface of the seal member 19, the toner is securely replenished to the replenishing port 2 of the developer reservoir section 1 through the toner delivery port 6 and the toner through-hole 20, thereby, the developer can be securely replenished to the toner replenishing port, without using a member rotated together with the toner bottle.

In this connection, when the seal member 19 has the shape in which the ring-shaped groove 117 is provided on the inner peripheral surface such that the groove passes on the toner through-hole 20, or the shape in which the ring-shaped space 118 is provided in the member 19, the toner adhered to edge portions of the toner delivery port 6 provided on one side of the small cylindrical portion of the toner bottle 5 is not conveyed to the inner surface of the seal member 19 by the rotation of the toner bottle 5, and the toner is not accumulated on the inner surface of the seal member 19 with the passage of time, thereby, it does not cause toner leaking.

As described above, the present invention is a developer replenishing apparatus provided with: a developer reservoir section to store the developer; and a developer storing container in which the developer (toner) is moved from the large cylindrical portion toward the small cylindrical portion by the spiral groove provided on the peripheral surface by rotating in the peripheral direction, and the developer (toner) can be replenished from the delivery port provided on one side of the small cylindrical portion to the replenishing port of the developer reservoir section, and the developer replenishing apparatus is characterized in that a ring-shaped seal member is mounted such that a developer through-hole coincides with the replenishing port of the developer on the upper surface of the developer reservoir section, wherein the ring-shaped seal member can slidingly contact with portions sandwiching the delivery port of the small cylindrical portion of the developer storing container (toner bottle) between them and facing each other, and has the developer through-hole (toner through-hole) on its one side. Thereby, the developer replenishing apparatus of the present invention has excellent effects that, even when a member rotated together with the developer storing container (toner bottle) is disused, the delivery port can be securely sealed, thereby, not only troublesome adjustment is not necessary, but reduction of the production cost can also be expected.

Further, the present invention is characterized in that the seal member is provided with the ring-shaped groove, which passes on the developer through-hole, on the inner peripheral surface. Thereby, the present invention has an effect that the toner adhered to the toner delivery port is not conveyed to the inner peripheral surface (sliding-contact surface) of the seal member at the time of sliding-contact rotation of the developer storing container.

Still further, the present invention is characterized in that the seal member comprises: two ring members which face each other and sandwich the delivery port provided on one side of the neck portion of the developer storing container, between them; and a shell member fixed such that it covers the outer periphery of both ring members. Therefore, the present invention has an effect that the surface with which the toner delivery port of the toner bottle slidingly contacts, is the ring-shaped space, thereby, the toner adhered to the toner delivery port is not conveyed to the inner peripheral surface (sliding-contact surface) of the seal member, and an effect that disintegration of the seal member becomes easy and easily disassembled when the seal member is replaced due to deterioration.

Figure 12:
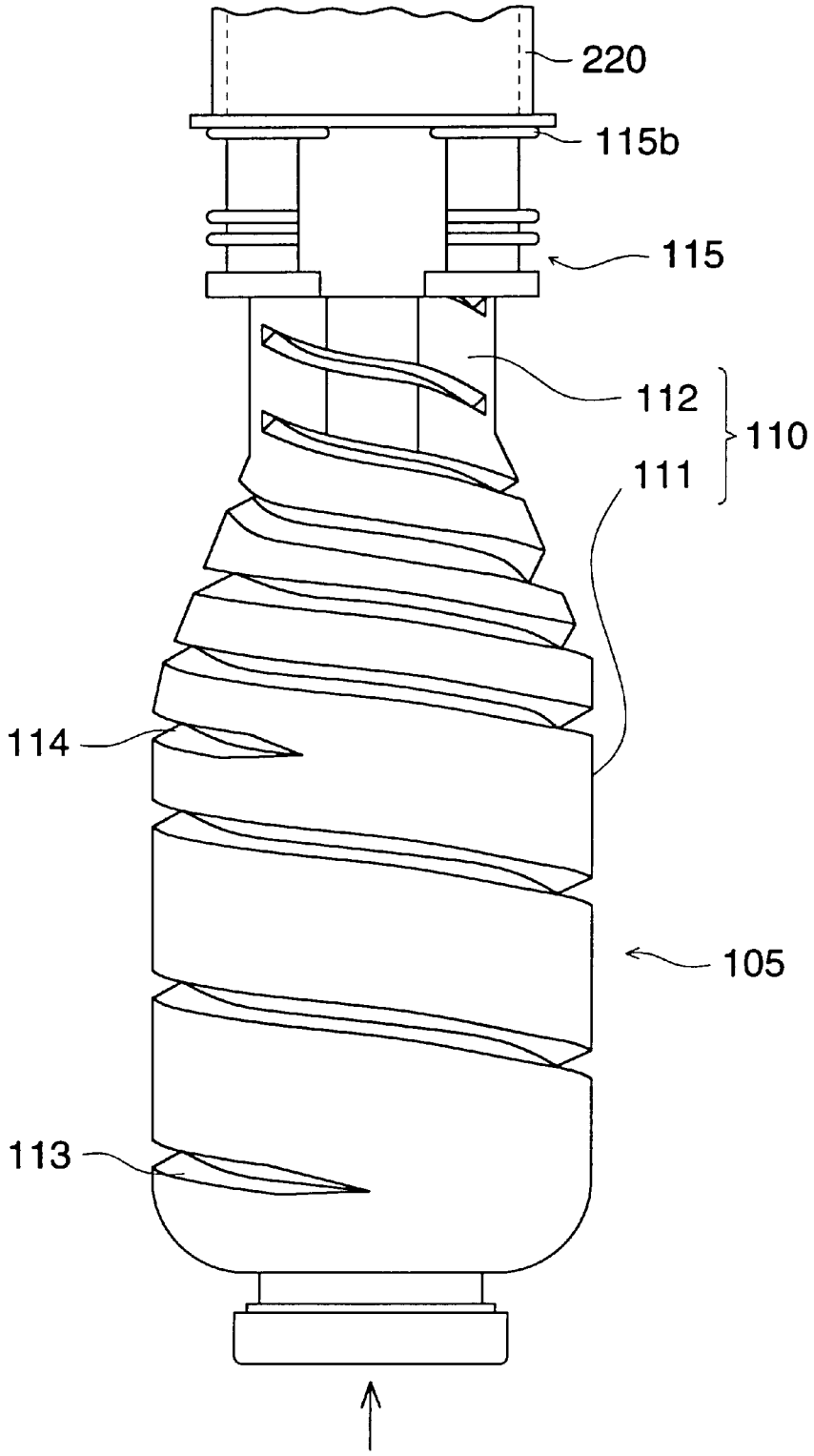
FIG. 12 is a plan view of a toner storing container 105 of the present example.

FIG. 12 is a plan view of the toner storing container 105 according to the present invention. The toner storing container 105 formed of resin material is structured by a main body 110 and a shutter member 115. In FIG. 12, the main body 110 is structured such that a large cylindrical portion 111 is smoothly connected to a small cylindrical portion 112. A spiral groove 113 is formed on the outer periphery of the container from the vicinity of the bottom portion of the large cylindrical portion 111 toward the small cylindrical portion 112, on the other hand, a spiral groove 114 is formed on the outer periphery of the container from the vicinity of the upper portion of the large cylindrical portion 111 toward the small cylindrical portion 112. In this connection, in FIG. 12, a pipe-shaped member which is in contact with an upper end of the small cylindrical portion 112, is a shutter driving member 220 corresponding to the supporting frame 21 in the developer replenishing apparatus 100 (FIG. 1).

Figure 13:
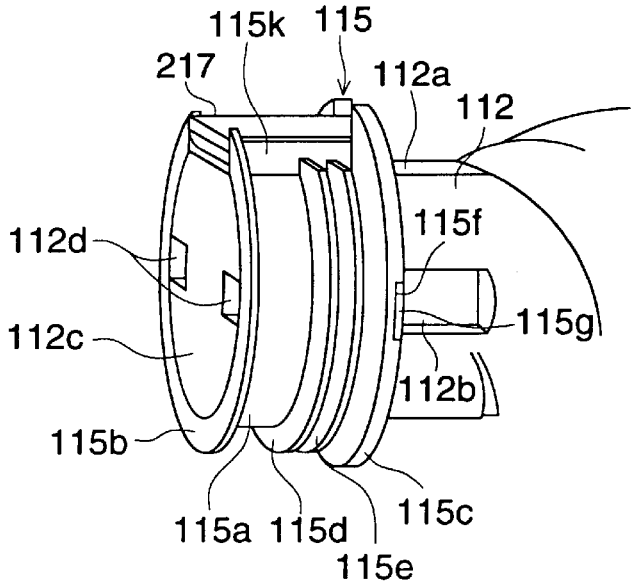
FIG. 13 is a perspective view showing the vicinity of a small cylindrical portion 112 of the toner storing container 105.

FIG. 13 is a perspective view showing the vicinity of the small cylindrical portion 112 of the main body 110. In FIG. 13, a flat surface portion 112*a* is formed on the upper portion of the small cylindrical portion 112, and guiding grooves 112*b* are formed on both side portions of the small cylindrical portion 112. Further, the left end surface 112*c* of the small cylindrical portion 112 is closed, and concave portions

112*d* are formed on both side portions in the horizontal direction of the left end surface 112*c*. Incidentally, the guiding groove 112*b* is not opened outward at the left end 112*c*, and ends in the shutter member 115.

An almost cylindrical shutter member 115 is provided around the small cylindrical portion 112 such that the shutter member 115 can slide in the axial direction of the toner storing container 105. The shutter member 115 is structured by: a cylindrical shutter main body 115*a* forming a flat member 115*h* (refer to FIGS. 14 and 15) on the upper portion thereof in FIG. 13; a driving flange 115*b* extending to the external in the radius direction from the left end of the shutter main body 115*a*; a large flange 115*c* extending to the external in the radius direction from the right end of the shutter main body 115*a*; 2 device type discrimination flanges 115*d* and 115*e* extending to the external in the radius direction from the middle of the shutter main body 115*a*. The upper portion of each flange is cut out corresponding to the flat member 115*f*. Further, in the cut-out portion, 2 side walls 115*k* (only one is shown in the drawing) extending in parallel to the axial direction are provided such that the driving flange 115*b* is connected to the large flange 115*c*. Upper ends of both side walls 115*k* are connected to side ends of the flat member 115*f*.

Groove portions 115*f* forwarding in the radius direction are formed on both side portions in the horizontal direction of the large flange 115*c*, and guiding pieces 115*g* are inserted into these grooves 115*f*. The inner end of the guiding piece 115*g* is engaged with the guiding groove 112*b*.

Figure 14:
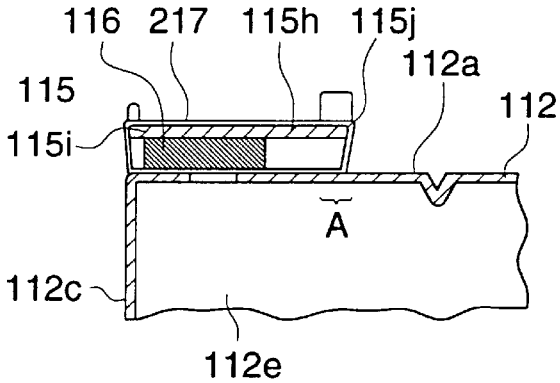
FIG. 14 is a view in which an upper central portion of a shutter member 115 is cut in the axial direction, and is shown together with the small cylindrical portion 112, and is a view showing a state in which the shutter member 115 is located at a sealing position.
Figure 15:
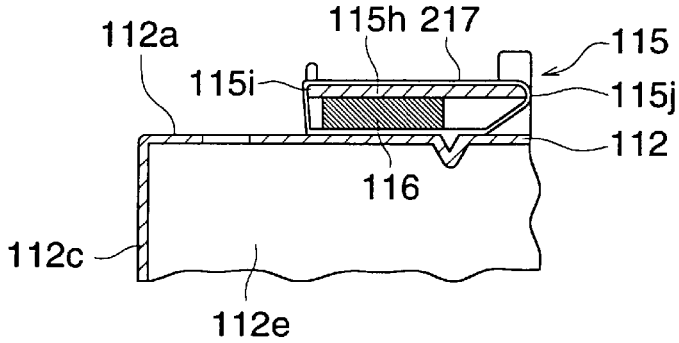
FIG. 15 is a view in which the upper central portion of the shutter member 115 is cut in the axial direction, and is shown together with the small cylindrical portion 112, and is a view showing a state in which the shutter member 115 is located at a withdrawal position.

FIGS. 14 and 15 are views in which the center of the upper portion of the shutter member 115 is cut in the axial direction and shown together with the small cylindrical portion 112. FIG. 14 is a view showing a state in which the shutter member 115 is located at a shielding position, and FIG. 15 is a view showing a state in which the shutter member 115 is located at a withdrawal position. In FIGS. 14 and 15, the small cylindrical portion 112 forms a rectangular toner delivery port 112*e* on the flat surface portion 112*a* of the upper portion in the vicinity of the left end surface 112*c* thereof.

Linear edge portions 115*i* and 115*j* are formed on the left end and the right end of a flat member 115*h* of the shutter member 115. A thin board elastic member 116 is fixedly adhered on the lower surface of the flat member 115*h*. The elastic member 116 has a function to press a seal member 217, which will be described later, to the delivery port 112*e*, and can be formed of foaming urethane, and as an example, PERON LE-20 (trade name) sold by INOAC corporation Co., may be used. Such the material has a small compression residual strain and the elasticity which is hardly deteriorated, therefore, a pressing force more than a predetermined value can be secured for a long period of time. An endless track sealing sheet 217 is arranged such that it surrounds the flat member 115*h* and the elastic member 116 without a slack. The sealing sheet 217 is fixedly adhered in the area A (FIG. 14) of the flat surface portion 112*a* such that the seal member 217 is not peeled off.

Next, operations of the present example will be described. Initially, in a new toner storing container 105, the sealing sheet 217 is attached around the delivery port 112*e* by thermal fusing so that the toner inside the container 105 is not spilt out from the delivery port 112*e* during conveyance or the like.

When developer (toner) replenishment is necessary in the image forming apparatus, and the toner storing container is replaced to a new toner storing container 105 in the developer replenishing apparatus, as shown in FIG. 12, the driving flange 115*b* of the shutter member 115 is brought into contact with the driving member 220, and the bottom portion of the toner storing container 105 is pushed upward. This operation is carried out when the operator turns on a lever of the developer replenishing apparatus.

Thereby, the toner storing container 105 is moved upward, however, the movement of the shutter member 115 is limited by driving member 220, the shutter member 115 is relatively moved with respect to the toner storing container 105. This state is shown in FIG. 15. In this connection, the guiding piece 115*g* is guided along the guiding groove 112*b* so that the shutter member 115 is not rotated around the axis with respect to the toner storing container 105, but moved in the axial direction. Incidentally, as described above, the guiding groove 112*b* is not open at the end portion of the toner storing container 105, therefore, when the guiding piece 115*g* is engaged with the end of the groove 112*b*, the shutter member 115 can also be prevented from slipping out.

Herein, the sealing sheet 217 is fixedly attached to the flat surface portion 112*a* at the area A as described above, therefore, when the shutter member 115 is relatively moved with respect to the toner storing container 105, the sealing sheet 217 slidingly moves along the upper surface of the flat member 115*h* (refer to FIGS. 14 and 15). At this time, adhesion by thermal fusing around the delivery port 112*e* is peeled off, thereby, the delivery port 112*e* is exposed without staining the operator's hands.

After the delivery port 112*e* is exposed, the leading edge of the fork (not shown) of the toner replenishing device is inserted into the concave portions 112*d* (FIG. 13) of the toner storing container 105, and by rotating that, the delivery port 112*e* faces downward, and the toner in the container is delivered. Further, every time when the toner storing container 105 is rotated, the toner, which is powder, is pushed toward the delivery port 112*e* by the spiral grooves 113 and 114 formed on its outer periphery, thereby, new toner is supplied each time when the delivery port 112*e* faces downward.

Further, the delivery port 112*e* is provided on the flat surface portion 112*a*, therefore, the peeled sealing sheet 217 is also flat. Further, the sealing sheet 217 is uniformly squeezed through linear edge portions 115*i* and 115*j* of the flat member 115*h*, thereby, the sealing sheet 217 is maintained in flat surface-like condition in which no-wrinkling exists entirely.

Incidentally, sometimes there is a case in which the operator requires to remove the toner storing container 105 in which toner sill remains, from the developer replenishing apparatus. In such the case, in the conventional technology, the seal member which is peeled once, has wrinkles, and it can not be adhered to the delivery port again, therefore, sometimes the circumference is stained by toner spilt from the delivery port.

In contrast to this, according to the present example, the seal member is maintained in flat surface condition without a wrinkle, therefore, when the shutter member 115 is moved again to the sealed condition shown in FIG. 14, the entire surface of the delivery port 112*e* can be sealed by the sealing sheet 217. Further, the thermal adhesion of the sealing sheet 217 is not effective after being peeled once, however, the elastic member 116 presses the sealing sheet 217 onto the delivery port 112*e*, thereby, the delivery port 112*e* can be more effectively sealed.

As described above, according to the present example, an excellently operatable toner storing container can be provided, in which the operator can peel the seal member off without hands being stained, and the seal member can be reused.

Referring to examples, the present invention is detailed above. However, for example, the seal member may be structured such that it is not formed in the endless track-like shape, but one end is fixed on the flat surface portion and the other end is pulled by a spring member.

According to the toner storing container of the present invention, the seal member is collected while being squeezed through the linear edge portion of the shutter member. Therefore, by moving the shutter member, the seal member can be peeled and collected while maintaining the flatness of the seal member, on the other hand, the collected seal member has no wrinkle, thereby, it can be reused and the delivery port can be sealed.

What is claimed is:

1. A developer replenishing apparatus comprising:

(a) a developer storing container for storing a developer therein;

(b) a first driving source for rotating the developer storing container to supply the developer;

(c) a developer reservoir section for receiving the developer supplied from the developer storing container;

(d) a conveying screw for replenishing the developer in the developer reservoir section onto a developing device;

(e) a second driving source for driving the conveying screw; and (f) a stirring member for stirring the developer in the developer reservoir section, the stirring member having first and second one-way clutches provided on a driving shaft thereof, wherein the stirring member is driven by the first driving source through the first one-way clutch, and driven by the second driving source through the second one-way clutch.

2. The developer replenishing apparatus of claim 1 further comprising:

a sensor provided in the developer reservoir section for detecting the developer reserved in the developer reservoir section; and a control section for controlling the first driving source according to a detected result of the sensor, wherein when the detected result shows that the developer is exhausted, the control section makes the sensor to detect again the developer after a predetermined period of time elapses, and then when the detected result shows again that the developer is exhausted, the control section controls the first driving source to drive.

3. The developer replenishing apparatus of claim 2, wherein the predetermined period of time indicates a time required for the stirring member to rotate a constant angle for stirring the developer in the developer reservoir section.

4. The developer replenishing apparatus of claim 2 further comprising a cleaning member for cleaning a detecting surface of the sensor.

5. The developer replenishing apparatus of claim 4, wherein the predetermined period of time indicates a time required for the stirring member to rotate a constant angle for stirring the developer in the developer reservoir section after the cleaning member cleans the detecting surface of the sensor.

6. The developer replenishing apparatus of claim 4, wherein the cleaning member is integrated in the stirring member.

7. The developer replenishing apparatus of claim 1 further comprising:

a supporting frame for supporting a small cylindrical portion of the developer storing container on which an exhaust port is provided; and a circular sealing member for sealing a space between the supporting frame and the small cylindrical portion, wherein the developing storing container is rotated by the first driving source to supply the developer onto the developer reservoir section while a circumferential surface of the small cylindrical portion rubs against the circular sealing member.

8. The developer replenishing apparatus of claim 7, wherein the circular sealing member has a developer through-hole provided so as to coincide with a supplying hole through which the developer in the developer storing container is supplied to the developer reservoir section.

9. The developer replenishing apparatus of claim 8, wherein the circular sealing member has a circular groove which passes the developer through-hole and is provided on an inner circumferential surface thereof.

10. The developer replenishing apparatus of claim 1, wherein the developer storing container comprises:

a main body for storing the developer therein, having a small cylindrical portion on which a flat surface is provided;

an exhaust port provided on the flat surface through which the developer in the developer storing container is exhausted;

a shutter member provided movably between a closing position at which the exhaust port is closed and a receding position at which the exhaust port is released; and a sealing sheet for covering the exhaust port when the shutter member is located at the closing position, wherein when the shutter member is moved from the closing position to the receding position, the sealing sheet is moved with the shutter member, thereby the exhaust port is released.

11. The developer replenishing apparatus of claim 10, wherein the shutter member includes a linear edge portion, when the stutter member is moved from the closing position to the receding position, the sealing sheet is moved while the sealing sheet is scraped by the linear edge portion.

12. The developer replenishing apparatus of claim 10, wherein the main body of the developer storing container includes a spiral groove provided in an inner surface thereof by which the developer in developer storing container is moved toward the exhaust port when the first driving source operates.

13. The developer replenishing apparatus of claim 10, wherein the shutter member includes an elastic body for pressing the sealing sheet toward the exhaust port.

14. The developer replenishing apparatus of claim 10, wherein the shutter member is movably provided in an axis direction of the developer storing container which is a direction perpendicular to a circumferential direction of the small cylindrical portion, and when the developer storing container is attached to or detached from the developer replenishing apparatus, the shutter member is moved between the closing position and the receding position.

* * * * *